US012421687B2

(12) United States Patent
Cottingham et al.

(10) Patent No.: US 12,421,687 B2
(45) Date of Patent: Sep. 23, 2025

(54) COUPLING DEVICE

(71) Applicant: J. C. Bamford Excavators Limited, Uttoxeter (GB)

(72) Inventors: Darryl Cottingham, Uttoxeter (GB); Simon J. Ratcliffe, Uttoxeter (GB); Jamie Thomas Lewis Shenton, Uttoxeter (GB)

(73) Assignee: J. C. Bamford Excavators Limited, Uttoxeter (GB)

( * ) Notice: Subject to any disclaimer, the term of this patent is extended or adjusted under 35 U.S.C. 154(b) by 865 days.

(21) Appl. No.: 17/680,286

(22) Filed: Feb. 24, 2022

(65) Prior Publication Data

US 2022/0282446 A1 Sep. 8, 2022

(30) Foreign Application Priority Data

Mar. 2, 2021 (GB) ..... 2102914

(51) Int. Cl.
*E02F 3/36* (2006.01)

(52) U.S. Cl.
CPC ..... *E02F 3/3681* (2013.01); *E02F 3/3618* (2013.01); *E02F 3/3663* (2013.01)

(58) Field of Classification Search
CPC ..... E02F 3/3681; E02F 3/3618; E02F 3/3663; E02F 3/3627; E02F 3/32; E02F 3/3677; E02F 3/435; E02F 3/437; E02F 9/265; E02F 9/2004
See application file for complete search history.

(56) References Cited

U.S. PATENT DOCUMENTS

2016/0145832 A1* 5/2016 Stockhaus ..... E02F 3/32 414/815
2021/0095441 A1* 4/2021 Jonsson ..... E02F 3/3681
2022/0018090 A1* 1/2022 Schauer ..... E02F 3/3627

FOREIGN PATENT DOCUMENTS

| | | | |
|---|---|---|---|
| EP | 3 231 946 | A2 | 10/2017 |
| JP | 2001020313 | A | 1/2001 |
| KR | 101 783 958 | B1 | 10/2017 |
| KR | 101988828 | B1 | 6/2019 |
| KR | 20200117471 | A | 10/2020 |
| WO | WO-2018/083083 | A1 | 5/2018 |
| WO | WO-2020/151876 | A1 | 7/2020 |

OTHER PUBLICATIONS

Search Report for GB 2102914.5, dated Nov. 26, 2021.
Extended European Search Report issued in EP 22156998.1, dated Jul. 7, 2022.

* cited by examiner

*Primary Examiner* — Joseph M Rocca
*Assistant Examiner* — Robert E Pezzuto
(74) *Attorney, Agent, or Firm* — MARSHALL, GERSTEIN & BORUN LLP

(57) ABSTRACT

A coupling device connecting a working implement to a working arm of a working machine. The device has a first coupler body, a second coupler body pivotally mounted to the first coupler body, and a third coupler body rotatably mounted to the second coupler body so as to be rotatable about a second axis. The coupling device includes first and second spaced apart actuators configured to tilt the second coupler body relative to the first coupler body, where the coupling device comprises a first end and a second end, and wherein the first and second actuators are arranged on the first end.

21 Claims, 6 Drawing Sheets

COUPLING DEVICE

FIELD

The present teachings relate to a coupling device and to a working machine comprising a coupling device attached thereto.

BACKGROUND

Working machines, also known as off-highway vehicles, typically have a working arm pivotally mounted to the body of the machine, and a working implement, such as a bucket or a grabber, attached to the end of the arm via a coupling device. Attachment of the working implement enables the working machine to perform working operations. In order to increase the manoeuvrability of the working implement, it is desirable to be able to move the implement in any direction. To provide this improved manoeuvrability, the coupling device may be capable of tilting the working implement relative to the working arm and also of rotating the working implement relative to the working arm. Such coupling devices are known as tiltrotators. In order to provide tilting of the working implement, the tiltrotator typically includes two actuators (e.g. hydraulic actuators). In known tiltrotators, however, the packing of the different components may be such that operation of the tiltrotator in narrow spaces is difficult.

The present teachings seek to overcome or at least mitigate one or more problems associated with the prior art.

SUMMARY

A first aspect of the teachings provides for a coupling device for connecting a working implement to a working arm of a working machine, the coupling device comprising: a first coupler body comprising an arm mounting arrangement configured to be connectable to a working arm of a working machine; a second coupler body pivotally mounted to the first coupler body so as to be capable of tilting about a first axis; a third coupler body rotatably mounted to the second coupler body so as to be rotatable about a second axis, where the second axis is arranged at an angle to the first axis, the third coupler body comprising an implement mounting arrangement configured to be connectable to a working implement; and first and second spaced apart actuators configured to tilt the second coupler body relative to the first coupler body about the first axis, wherein the coupling device comprises a first end and a second end, and wherein the first and second actuators are arranged on the first end.

Arranging the first and second actuators at the same end of the coupling device) enables the footprint of the coupling device to be narrower, which has been found to facilitate operation of a working implement attached to the coupling device.

The coupling device may be mounted to a working arm of a working machine, the first end is arranged distal to the working arm and the second end is arranged proximate to the working arm.

Arranging the actuators on an opposing side of the coupling device to the arm further enables the footprint of the coupling device to be narrower.

The first and second actuators may be arranged side-by-side.

The first and second actuators may be arranged adjacent to each other.

This arrangement further enables the footprint of the coupling device to be narrower.

The second coupling body may define a width in a direction perpendicular to an axis extending between the first and second ends. The first and second actuators may be arranged to be narrower than the width of the second coupling body.

The first and second actuators may define a width that is less than the width of the second coupling body.

In this arrangement, the widest part of the coupling device is the second coupling body, which has been found to further improve the packing of the coupling device, enabling a narrower coupling device to be provided.

The arm mounting arrangement may comprise first and second arm mounts configured to receive first and second pivot pins, respectively, to pivotally mount the coupling device to a working arm of a working machine.

This enables the coupling device to pivot relative to the working arm about the pivot axis X.

The first arm mount may comprise a first pair of spaced apart apertures configured to receive a first pivot pin therethrough to pivotally mount the coupling device to a working arm of a working machine. The first arm mount may be provided on the second end of the coupling device.

The first arm mount is provided on an opposing side of the coupling device to the first and second actuators.

This arrangement has been found to further improve the packing of the coupling device, enabling a narrower coupling device to be provided.

The second arm mount may comprise a second pair of spaced apart apertures configured to receive a second pivot pin therethrough for connecting the coupling device to an actuator of a working machine. The spaced apart apertures may define an axis extending therebetween that intersects the second axis.

This arrangement has been found to improve the manoeuvrability/operability of an implement mounted to the coupling device.

The first and second actuators may be pivotally connected to the second coupler body at first and second connection points, respectively, and the first and second connection points may be equally spaced apart from the first axis.

The first and second connection points and the first axis may be arranged so as to define a substantially equilateral triangle.

The first coupler body may comprise first and second actuator mounts configured to fixedly mount the first and second actuators thereto, respectively.

The first and second actuator mounts may comprise first and second recesses, respectively, each recess defining an opening through which the first and second actuators at least partially extend.

The first and second actuator mounts may comprise at least one aperture through the first coupler body so as to define at least one opening through which the first and second actuators at least partially extend.

The first and second actuators may be pivotally connected to the second coupler body at first and second connection points, respectively. The second coupler body may comprise a projection defining third and fourth recesses on opposing sides thereof defining the first and second connection points.

The first coupler body and second coupler body may each comprise complementary abutting surfaces configured and arranged to limit pivoting of the second coupler body relative to the first coupler body in first and second pivoting directions.

The coupling device may comprise a hydraulic motor mounted to the second coupler body. The hydraulic motor may be positioned on the second end of the coupling device.

The first coupler body and second coupler body may be pivotally connected by two spaced apart tilt pins extending along the first axis.

A hydraulic manifold may be interposed between the first and second tilt pins.

The third coupler body may be rotatably mounted to the second coupler body via a slewing arrangement.

The slewing arrangement may comprise a worm gear.

The third coupler body may be a quick coupler, e.g. a hydraulic quick coupler.

The implement mounting arrangement may comprise first and second recesses configured to receive first and second implement pins therein.

The first and second actuators may be arranged so as to be substantially parallel.

The coupling device may be a tiltrotator.

A second aspect of the teachings provides for a working machine comprising: a body; a ground engaging propulsion structure supporting the body; and a working arm mounted to the body, wherein a coupling device according to any preceding claim is mounted to a distal end of the working arm.

The body may comprise an undercarriage supported by the ground engaging propulsion structure and a superstructure, e.g. a rotatable superstructure, connected to the undercarriage.

The working arm may be mounted to the superstructure.

The working machine may comprise an operator cab, wherein an operator seat is positioned within said operator cab.

BRIEF DESCRIPTION OF THE DRAWINGS

Embodiments will now be described with reference to the accompanying drawings, in which.

DETAILED DESCRIPTION OF EMBODIMENT(S)

Figure 1:
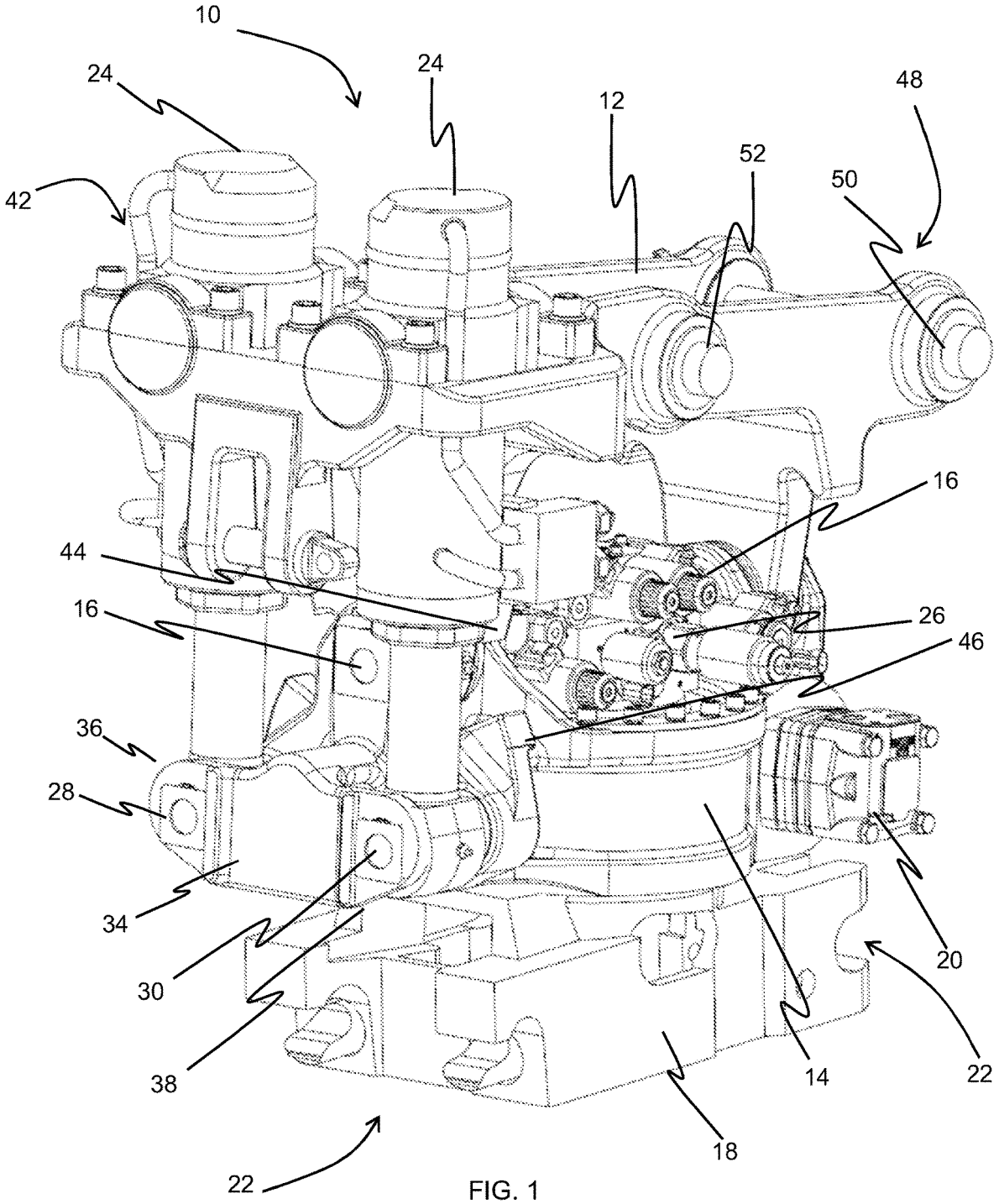
FIG. 1 is an isometric view of a coupling device.

Referring firstly to FIG. 1, a coupling device is illustrated and is indicated generally at 10. The coupling device 10 is connectable to a working arm of a working machine (not shown) so as to connect a working implement (not shown) to the working machine. The coupling device 10 is configured to tilt and rotate a working implement attached thereto. Put another way, the coupling device 10 is a tiltrotator 10.

The coupling device 10 includes a first coupler body 12. The first coupler body 12 is integrally formed, e.g. integrally cast, as a unitary component. It will be appreciated that in alternative arrangements, the first coupler body 12 may be fabricated, forged, or may be formed from any suitable manufacturing method. The first coupler body 12 is pivotally connectable to a working arm so as to be pivotable about a pivot axis X. The pivot axis X is a lateral axis or horizontal axis. Put another way, the pivot axis X is a substantially transverse axis of the working machine to which the coupling device 10 is mounted. When the coupling device 10 is connected to a working machine, the pivot axis X is substantially parallel to a rotational axis between the working arm and the body of the working machine.

The coupling device 10 includes a second coupler body 14. The second coupler body 14 is integrally formed, e.g. integrally cast, as a unitary component. It will be appreciated that in alternative arrangements, the second coupler body 14 may be fabricated, forged, or may be formed from any suitable manufacturing method. The second coupler body 14 is pivotally mounted to the first coupler body 12. The second coupler body 14 is pivotable relative to first coupler body 12 about a first axis Y. Pivotally mounting the second coupler body 14 to the first coupler body 12 enables the second coupler body 14 to tilt about the first axis Y. Put another way, the first axis Y is a tilt axis.

The first axis Y is arranged at an angle (i.e. a non-zero angle) relative to the pivot axis X. In the illustrated arrangement, the first axis Y is substantially perpendicular to the pivot axis X. The first axis Y is a substantially fore-aft axis. The first coupler body 12 and the second coupler body 14 are pivotally connected by two spaced apart tilt pins 16 extending along the first axis Y.

The coupling device 10 includes a third coupler body 18. The third coupler body 18 is rotationally mounted to the second coupler body 14. The third coupler body 18 is rotatable relative to second coupling body 14 about a second axis Z. The second axis Z is arranged at an angle (i.e. a non-zero angle) relative to the first axis Y and to the pivot axis X. In the arrangement shown, the second axis Z is arranged substantially perpendicular to the first axis Y and substantially perpendicular to the pivot axis X. The second axis Z is a substantially upright axis. Put another way, the second axis Z is a vertical axis.

The third coupler body 18 is rotatably mounted to the second coupler body 14 via a slewing arrangement. In the embodiment, the slewing arrangement comprises a worm gear (not shown). The coupling device 10 includes a device drive arrangement 20 configured to rotate the third coupler body 18 relative to the second coupler body 14. Put another way, the device drive arrangement 20 drives the slewing arrangement. The device drive arrangement 20 is interposed between the first and second tilt pins 16. The device drive arrangement 20 is provided in the form of a hydraulic motor 20 configured to drive the slewing arrangement. The hydraulic motor 20 is mounted to the second coupler body 14. The first and second actuators 24 are positioned on an opposing side of the second coupler body 14 to the hydraulic motor 20. Put another way, the first and second actuators 24 are positioned at the first end of the coupling device 10 and the drive arrangement 20 is positioned at the second end of the coupling device 10.

The coupling device 10 includes a hydraulic manifold 26. The hydraulic manifold 26 directs the flow of hydraulic fluid within the coupling device 10. The hydraulic manifold 26 selectively provides hydraulic fluid to the drive arrangement 20 to drive the slewing arrangement. Put another way, the hydraulic manifold 26 selectively provides hydraulic fluid to the drive arrangement 20 to rotate the third coupler body 18 relative to the second coupler body 14.

The third coupler body 18 includes an implement mounting arrangement 22 configured to be connectable to a working implement (not shown). In the embodiment, the third coupler body 18 is a quick coupler. The mounting arrangement 22 includes first and second recesses configured to receive first and second implement pins of a working implement (not shown) therein.

The coupling device 10 includes first and second spaced apart actuators 24 configured to tilt the second coupler body 14 relative to the first coupler body 12 about the first axis Y. The coupling device 10 includes a first end and a second end, and the first and second actuators 24 are arranged on the first end. When the coupling device 10 is mounted to a working arm of a working machine, the first end is arranged distal to the working arm and the second end is arranged proximate to the working arm. Put another way, when the coupling device 10 is mounted to a working arm of a working machine, the first end is a front end of the coupling device 10.

The first and second actuators 24 are arranged side-by-side on the coupling device 10. Put another way, the first and second actuators 24 are arranged adjacent to each other on the coupling device 10. The second coupler body 14 defines a width in a direction perpendicular to an axis extending between the first and second ends. The first and second actuators 24 are arranged to be narrower than the width of the second coupling body 14.

The first and second actuators 24 are arranged so as to be substantially parallel to each other. Put another way, each of the first and second actuators 24 define an elongate axis, and the two elongate axes are substantially parallel. In alternative arrangements, the first and second actuators 24 may be arranged at an angle relative to each other.

The first and second actuators 24 are arranged so as to be equally spaced apart from a central axis of the coupling device 10. In the embodiment, the first and second actuators 24 are arranged on a side of the coupling device 10 that is remote from the working arm, in use. The first and second actuators 24 are pivotally connected to the second coupler body 14 at first 28 and second 30 connection points, respectively. The first and second connection points 28, 30 are equally spaced apart from the first axis Y. In the embodiment, the first and second connection points 28, 30 and the first axis Y are arranged so as to define a substantially equilateral triangle.

The second coupler body 14 includes a projection 34 defining third 36 and fourth 38 recesses on opposing sides thereof. The projection 34 is positioned on a side of coupling device 10 remote from a working arm of a working machine, when the coupling device 10 is mounted to a working arm. The projection 34 extends in a direction away from a working arm of a working machine, when the coupling device 10 is mounted to a working arm. The recesses 36, 38 define the first and second connection points. The recesses 36, 38 each include a pair of opposing apertures configured to receive a pin 40 therein so as to pivotally mount the first and second actuators 24 to the second coupler body 14. The pins 40 define the first and second connection points 28, 30.

The first and second actuators 24 are fixedly mounted to the first coupler body 12. The first coupler body 12 includes first and second actuator mounts 32 to fixedly mount the first and second actuators 24 thereto. In the embodiment, the first and second actuator mounts 32 are provided in the form of at least one aperture 42 through the first coupler body 12 so as to define at least one opening through which the first and second actuators 24 at least partially extend. In the illustrated embodiment, the first coupler body 12 defines first and second apertures receiving the first and second actuators, respectively. The first and second actuator mounts 32 are positioned on a side of coupling device 10 remote from a working arm of a working machine, when the coupling device 10 is mounted to a working arm.

The coupling device 10 is configured to limit the maximum angle that the first and second coupler bodies 12, 14 are able to tilt relative to each other. The first coupler body 12 and second coupler body 14 each comprise complementary abutting surfaces 44, 46 configured and arranged to limit tilting of the second coupler body 14 relative to the first coupler body 12 in first and second tilt directions.

The first coupler body 12 includes an arm mounting arrangement 48 for pivotally mounting the first coupler body 12 to a working arm of a working machine. The arm mounting arrangement 48 includes first and second arm mounts. The first and second arm mounts are provided in the form of two pairs of opposing pivot pin holes configured to receive first and second pivot pins 50, 52, respectively, therethrough to mount the coupling device 10 to a working arm.

The first pivot pin 50 pivotally mounts the coupling device 10 to the working arm. The first pivot pin 50 extends along the pivot axis X. In the embodiment, the second pivot pin 52 mounts a linkage arm connected to an actuator (see FIG. 6) configured to pivot the coupling device 10 about the pivot axis X. In some alternative arrangements, however, the coupling device 10 may not be pivotally mounted to the working arm, and the arm mounting arrangement 48 may fixedly mount the coupling device 10 to the working arm.

The first pivot pin 50 is received in the pair of spaced apart apertures of the first arm mount. The first pivot pin 50 (i.e. the first arm mount) is positioned on an opposing side of coupling device 10 to the first and second actuators 24. The second pivot pin 52 is received in the pair of spaced apart apertures of the second arm mount. The spaced apart apertures of the second arm mount define an axis extending therebetween that intersects the second axis Z. Put another way, the second pivot pin 52 extends along an axis that intersects the second axis Z.

Figure 2:
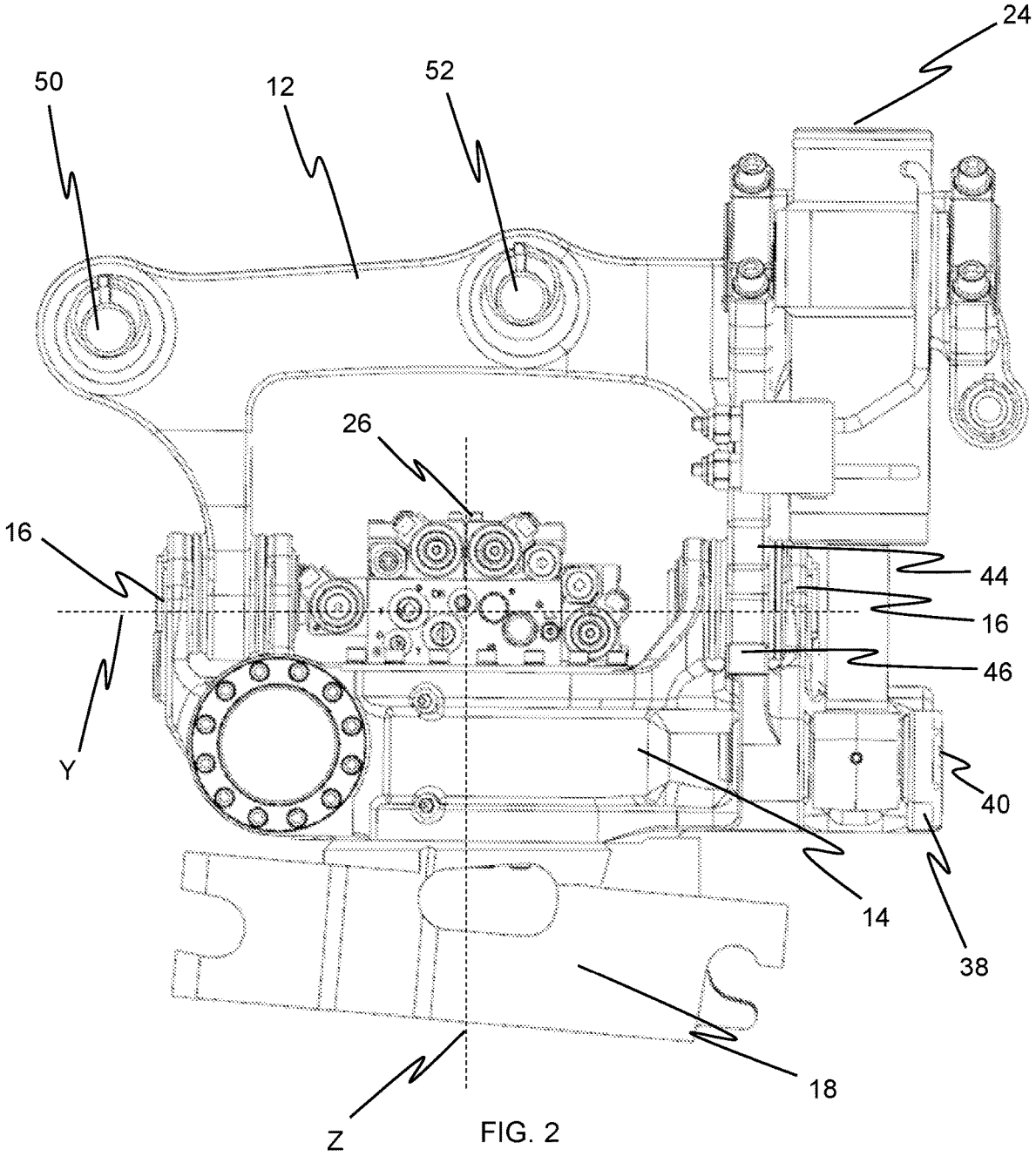
FIG. 2 is a side view of the coupling device of FIG. 1.
Figure 3:
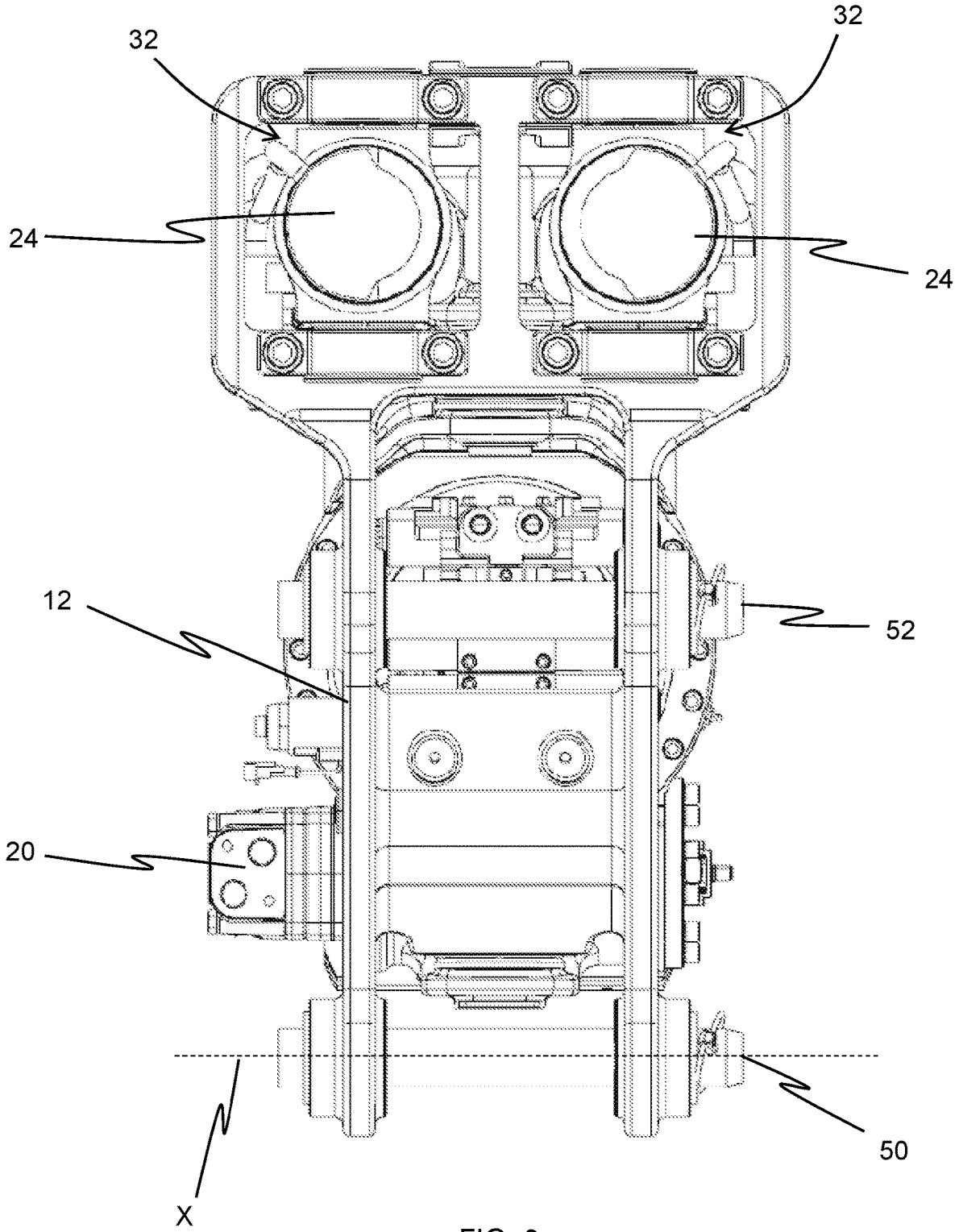
FIG. 3 is a plan view of the coupling device of FIG. 1.
Figure 4:
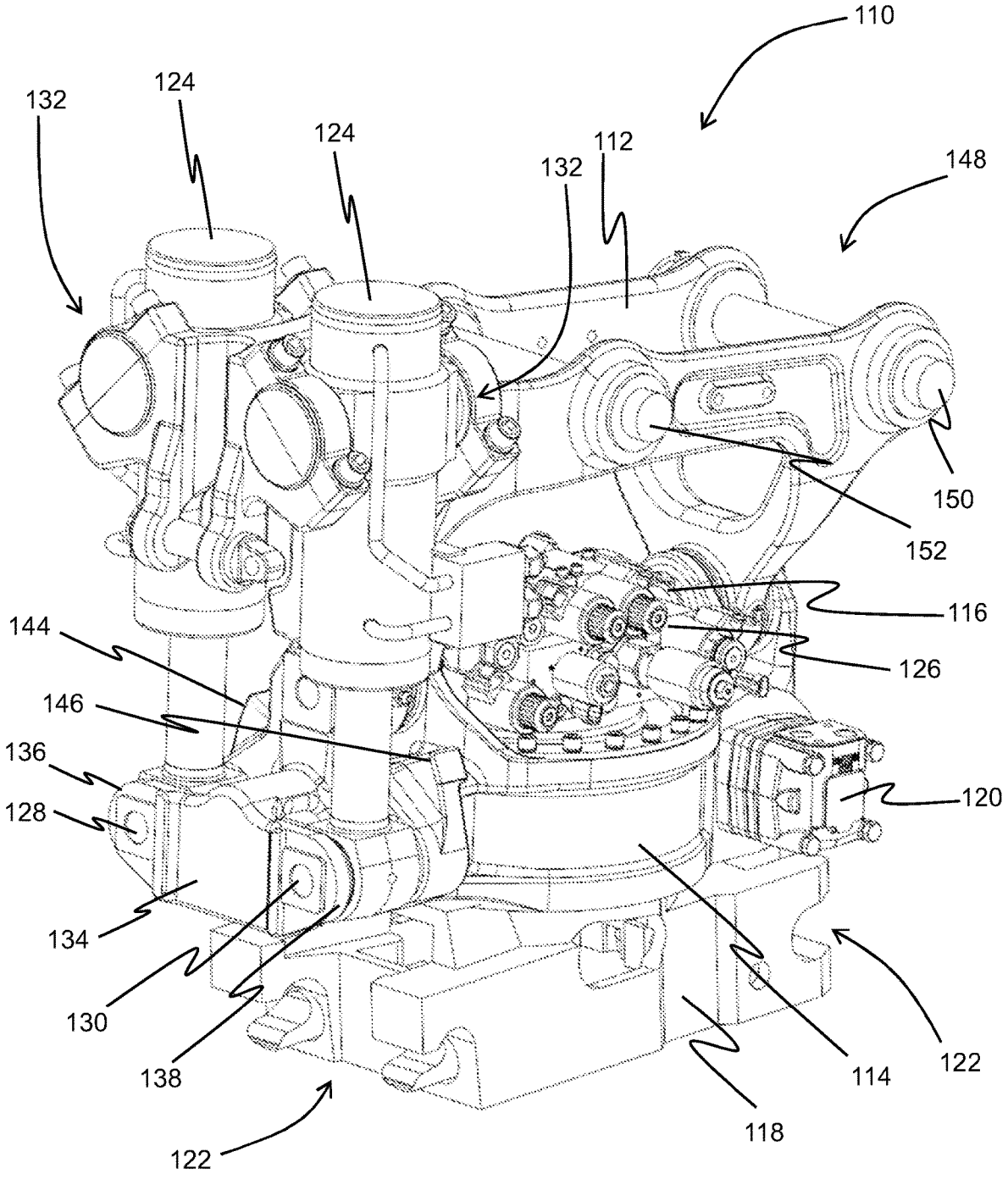
FIG. 4 is an isometric view of a coupling device.
Figure 5:
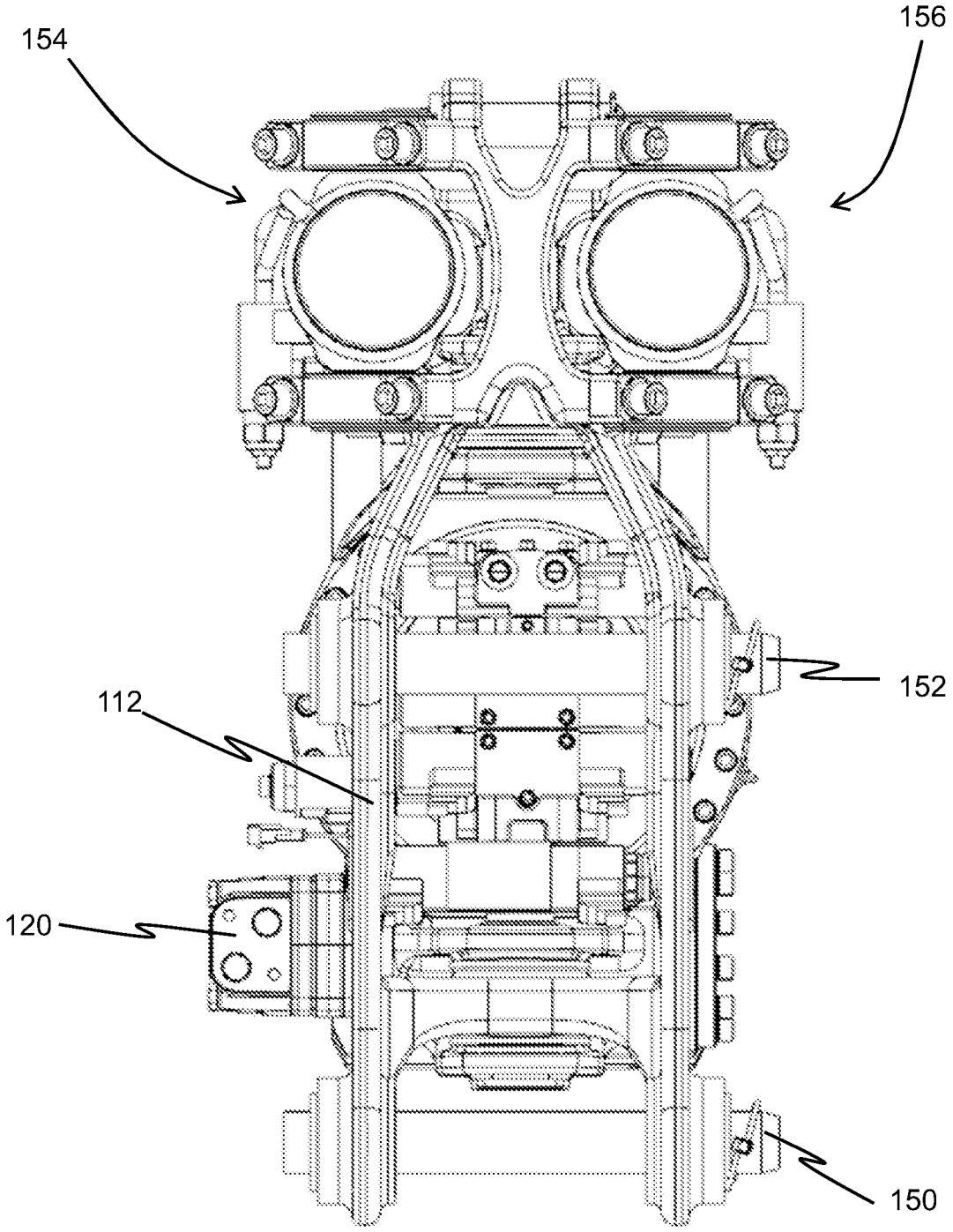
FIG. 5 is a plan view of the coupling device of FIG. 4.

Referring now to FIGS. 4 and 5, a coupling device 110 is illustrated. Corresponding components of embodiment with the embodiment of FIGS. 1 to 3 are labelled with the prefix '1' and only differences are discussed.

The first and second actuators 124 are fixedly mounted to the first coupler body 112. The first coupler body 112 includes first and second actuator mounts 132 to fixedly mount the first and second actuators 124 thereto. In the embodiment, the first and second actuator mounts 132 are provided in the form of first and second recesses 154, 156. Each of the first and second recesses 154, 156 define an opening through which the first and second actuators 124 at least partially extend. The first and second actuator recesses 154, 156 are positioned on a side of coupling device 110 remote from a working arm of a working machine, when the coupling device 110 is mounted to a working arm.

Figure 6:
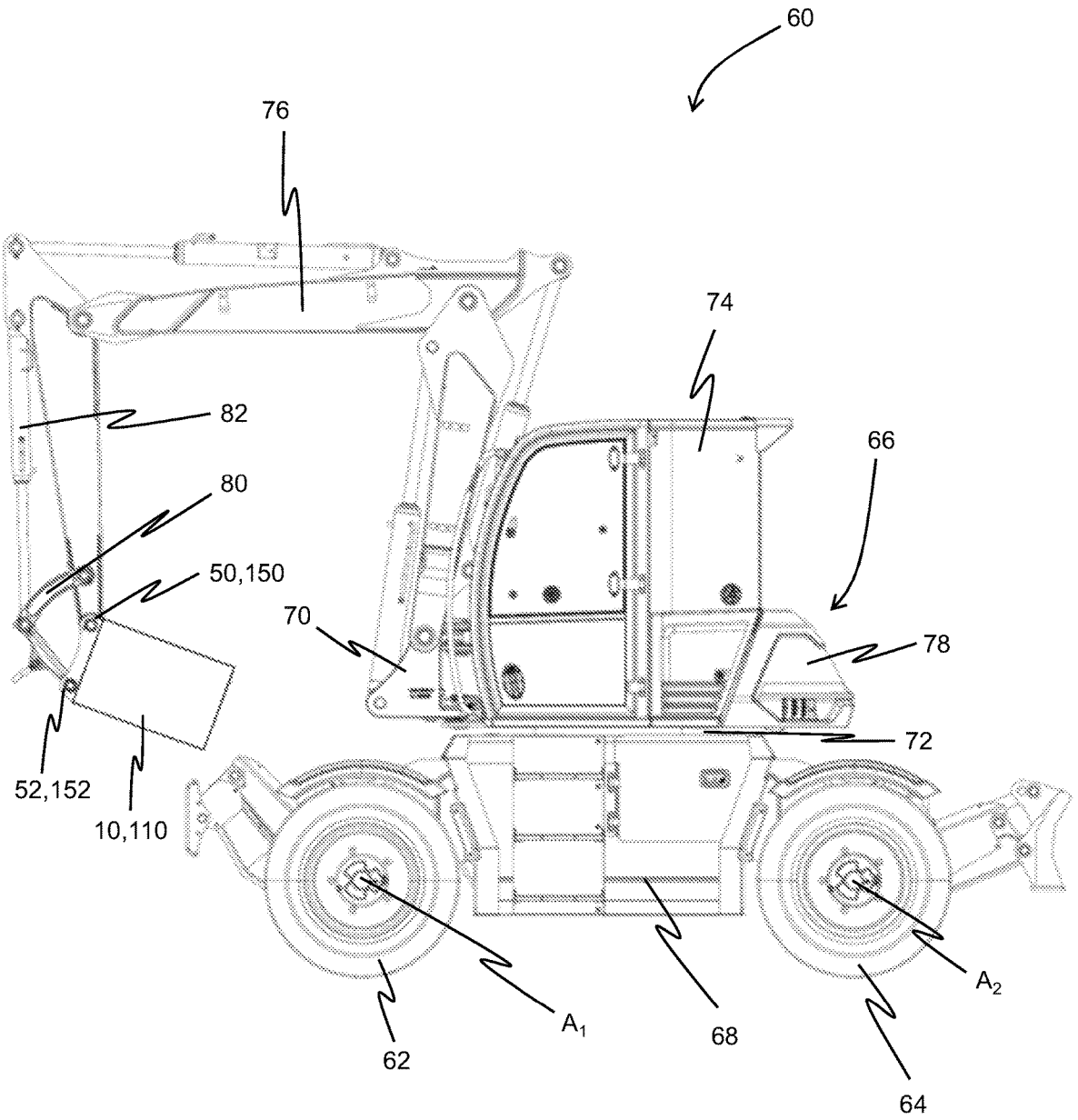
FIG. 6 is a side view of a working machine.

Referring to FIG. 6, there is illustrated a working machine 60. In the present embodiment, the working machine 60 may be considered to be an excavator. The working machine 60 could be any type of working machine such as an excavator having any operating weight, a loader, a telehandler etc. Such working machines may be denoted as off-highway vehicles.

The ground engaging propulsion structure includes a first, or front, axle A1 and a second, or rear, axle A2, each axle being coupled to a pair of wheels 62, 64. In other embodiments, the ground engaging propulsion structure may include a pair of endless tracks. One or both of the axles A1, A2 may be coupled to a drive arrangement (not shown) configured to drive movement of the ground engaging propulsion structure (i.e. the axles A1, A2). The drive arrangement causes movement of the working machine 60 over a ground surface. The drive arrangement includes a primer mover and a transmission. The prime mover may be an internal combustion engine, an electric motor, or may be a hybrid comprising both an internal combustion engine, an electric motor.

The working machine 60 has a body 66 supported on the ground engaging propulsion arrangement. The body 66 of the working machine 62 includes an undercarriage 68 supported on the ground engaging propulsion arrangement. A superstructure 70 is connected to the undercarriage 68. The superstructure 70 is connected to the undercarriage 68 by a mounting arrangement 72.

In the arrangement shown, the mounting arrangement 72 is a slewing mechanism in the form of a slewing ring. The mounting arrangement 72 permits unrestricted rotation of the superstructure 70 relative to the undercarriage 68 in this embodiment. In alternative arrangements it will be appreciated that the superstructure 70 may not be able to rotate relative to the undercarriage 68.

A cab 74 from which an operator can operate the working machine 60 is mounted to the superstructure 70. The cab 74 includes an operator seat (not shown). It will be appreciated that in some arrangements, the working machine 60 may not include a cab 74 and the operator seat may be directly mounted on the body 66 of the working machine 60.

The working machine 60 includes a working arm 76. The working arm 76 is connected to the body 66 and is provided for performing working operations. The working arm 76 is connected to the body 66. In the arrangement shown, the working arm 76 is connected to the superstructure 70. The working machine 60 includes a counterweight 78 having a mass for counterbalancing the working arm 76. The counterweight 78 is provided on the superstructure 70. In alternative arrangements, it will be appreciated that the counterweight may be omitted.

A coupling device 10, 110 is mounted to the working arm 76. The working arm 76 connects to the arm mounting arrangement 48, 148 of the coupling device 10, 110. The first pivot pin 50, 150 pivotally mounts the coupling device 10, 110 to the working arm 76. The second pivot pin 52, 152 mounts a linkage arm 80 connected to an actuator 82 configured to pivot the coupling device 10, 110 about the pivot axis X.

Although the teachings have been described above with reference to one or more preferred embodiments, it will be appreciated that various changes or modifications may be made without departing from the scope as defined in the appended claims.

The invention claimed is:

1. A coupling device for connecting a working implement to a working arm of a working machine, the coupling device comprising:

a first coupler body comprising an arm mounting arrangement configured to be connectable to the working arm of the working machine;

a second coupler body pivotally mounted to the first coupler body so as to be capable of tilting about a first axis;

a third coupler body rotatably mounted to the second coupler body so as to be rotatable about a second axis, where the second axis is arranged at an angle to the first axis, the third coupler body comprising an implement mounting arrangement configured to be connectable to the working implement; and first and second spaced apart actuators configured to tilt the second coupler body relative to the first coupler body about the first axis, wherein the coupling device comprises a first end and a second end, wherein the first and second actuators are arranged side-by-side and adjacent to each other on the first end, wherein the arm mounting arrangement comprises first and second arm mounts configured to receive first and second pins, respectively, to mount the coupling device to the working arm of the working machine, and wherein the first and second arm mounts are arranged such that the second pin is positioned between the first pin and the first and second actuators.

2. The coupling device according to claim 1, wherein the arm mounting arrangement is arranged so that when the coupling device is mounted to the working arm of the working machine, the first end is arranged distal to the working arm and the second end is arranged proximate to the working arm, such that the first end is spaced further from the working arm than the second end.

3. The coupling device according to claim 1, wherein the first and second actuators are arranged immediately adjacent to each other on the first end.

4. The coupling device according to claim 1, wherein the second coupling body defines a width in a direction perpendicular to a further axis extending between the first and second ends, and wherein the first and second actuators are arranged to be narrower than the width of the second coupling body.

5. The coupling device according to claim 1, wherein the first arm mount comprises a first pair of spaced apart apertures configured to receive a first pivot pin therethrough to pivotally mount the coupling device to the working arm of the working machine, and wherein the first arm mount is provided on the second end of the coupling device.

6. The coupling device according to claim 1, wherein the first and second actuators are pivotally connected to the second coupler body at first and second connection points, respectively, and wherein the first and second connection points are equally spaced apart from the first axis.

7. The coupling device according to claim 6, wherein the first and second connection points and the first axis are arranged so as to define a substantially equilateral triangle.

8. The coupling device according to claim 1, wherein the first coupler body comprises first and second actuator mounts configured to fixedly mount the first and second actuators thereto, respectively.

9. The coupling device according to claim 8, wherein the first and second actuator mounts comprise first and second recesses, respectively, each recess defining an opening through which the first and second actuators at least partially extend.

10. The coupling device according to claim 1, wherein the first and second actuators are pivotally connected to the second coupler body at first and second connection points, respectively, and wherein the second coupler body comprises a projection defining third and fourth recesses on opposing sides thereof defining the first and second connection points.

11. The coupling device according to claim 1, wherein the first coupler body and second coupler body each comprise complementary abutting surfaces configured and arranged to limit pivoting of the second coupler body relative to the first coupler body in first and second pivoting directions.

12. The coupling device according to claim 1, comprising a hydraulic motor mounted to the second coupler body, wherein the hydraulic motor is positioned on the second end of the coupling device.

13. The coupling device according to claim 1, wherein the first coupler body and the second coupler body are pivotally connected by two spaced apart tilt pins extending along the first axis.

14. The coupling device according to claim 13, wherein a hydraulic manifold is interposed between the two spaced apart tilt pins.

15. The coupling device according to claim 1, wherein the third coupler body is rotatably mounted to the second coupler body via a slewing arrangement.

16. The coupling device according to claim 1, wherein the third coupler body is a quick coupler, and wherein the implement mounting arrangement comprises first and second recesses configured to receive first and second implement pins therein.

17. The coupling device according to claim 1, wherein the first and second actuators are arranged so as to be substantially parallel.

18. The coupling device according to claim 1, wherein the coupling device is a tiltrotator.

19. A working machine comprising:

a body;

a ground engaging propulsion structure supporting the body; and a working arm mounted to the body, wherein a coupling device according to claim 1 is mounted to a distal end of the working arm.

20. A coupling device for connecting a working implement to a working arm of a working machine, the coupling device comprising:

a first coupler body comprising an arm mounting arrangement configured to be connectable to the working arm of the working machine;

a second coupler body pivotally mounted to the first coupler body so as to be capable of tilting about a first axis;

a third coupler body rotatably mounted to the second coupler body so as to be rotatable about a second axis, where the second axis is arranged at an angle to the first axis, the third coupler body comprising an implement mounting arrangement configured to be connectable to the working implement; and first and second spaced apart actuators configured to tilt the second coupler body relative to the first coupler body about the first axis, wherein the coupling device comprises a first end and a second end, wherein the first and second actuators are arranged side-by-side and adjacent to each other on the first end, wherein the arm mounting arrangement comprises an arm mount comprising a pair of spaced apart apertures configured to receive a pin therethrough to mount the coupling device to the working arm of the working machine, and wherein the arm mount is provided on the second end of the coupling device.

21. A coupling device for connecting a working implement to a working arm of a working machine, the coupling device comprising:

a first coupler body comprising an arm mounting arrangement configured to be connectable to the working arm of the working machine;

a second coupler body pivotally mounted to the first coupler body so as to be capable of tilting about a first axis;

a third coupler body rotatably mounted to the second coupler body so as to be rotatable about a second axis, where the second axis is arranged at an angle to the first axis, the third coupler body comprising an implement mounting arrangement configured to be connectable to the working implement; and first and second spaced apart actuators configured to tilt the second coupler body relative to the first coupler body about the first axis, wherein the coupling device comprises a first end and a second end, and wherein the first and second actuators are arranged side-by-side and immediately adjacent to each other on the first end.

* * * * *